United States Patent [19]

Riedle

[11] 3,958,731

[45] May 25, 1976

[54] LUGGAGE HANDLE EXTENSION HANDLE

[75] Inventor: Robert D. Riedle, Okemos, Mich.

[73] Assignee: Third Arm. Inc., Vandalia, Ill.

[22] Filed: Sept. 23, 1974

[21] Appl. No.: 508,151

[52] U.S. Cl. ..... 224/58; 224/5 M; 190/60

[51] Int. Cl.[2] ..... B65D 71/00

[58] Field of Search ..... 224/45 R, 49, 47, 55, 224/45 X, 45 S, 45 Q, 45 P, 43, 44, 5 M, 5 Q, 58; 190/42, 41, 55, 59, 60, 52, 57; 150/12, 33

[56] References Cited

UNITED STATES PATENTS

| | | | |
|---|---|---|---|
| 910,238 | 1/1909 | Shaw | 224/5 M |
| 1,916,793 | 7/1931 | Harper | 224/5 M |
| 2,319,729 | 5/1943 | Ford | 190/60 |
| 2,522,719 | 9/1950 | Johnson | 224/28 A |
| 3,363,827 | 1/1968 | Renner et al. | 190/57 |
| 3,665,551 | 5/1972 | Ender | 150/12 |
| 3,682,358 | 8/1972 | Richey | 224/5 N |
| 3,692,218 | 9/1972 | Friedman | 224/45 X |
| 3,804,311 | 4/1974 | Oglesbee | 224/49 |

*Primary Examiner*—Albert J. Makay
*Assistant Examiner*—Kenneth Noland
*Attorney, Agent, or Firm*—Woodard, Weikart, Emhardt & Naughton

[57] ABSTRACT

A unit is provided to facilitate carrying with one hand a plurality of handle bearing articles, such as suitcases, for example. The handle of one of the articles is encircled by the strap portion of the unit, and a handle portion at the ends of the strap portion is grasped in one hand together with the handle of another of the articles, to carry them. One embodiment has latching handle portions at opposite ends of the strap portion, and another embodiment has latching means at opposite ends of the strap portion, and an associated handle.

13 Claims, 15 Drawing Figures

LUGGAGE HANDLE EXTENSION HANDLE

BACKGROUND OF THE INVENTION

1. Field of the Invention

The invention is in the field of package and article carriers with handles and straps.

2. Description of the Prior Art

In the past, when carrying several articles which have handles, a person has been required to carry only one article in each hand or to attempt to grasp more than one handle in one or both of his hands. This has been a particular problem in regard to luggage where it is difficult, due to the width of the suitcases and short length of the handles, to even bring two suitcase handles into proximity so that they can be grasped together, let alone maintain a grasp on the handles for carrying the suitcases. Another problem is picking up cases of different sizes, and setting them down without dropping the smaller one.

Various means have been proposed for providing packaging and handles for articles, such as shown in U.S. Pat. No. 3,301,453 to Stewart, U.S. Pat. No. 3,493,154 to Engle, and British Pat. No. 372,055 to Chichester-Miles. None of these devices, however, provides means for accommodating a plurality of handles, such as luggage handles on items of luggage of different sizes. U.S. Pat. No. 3,554,417 to Yorty shows a flexible strap carrying device for a plurality of articles such as garments supported on hangers. The Yorty device includes a continuous strap which can only be fitted over handles having an open end, such as coat hanger hooks, and therefore is inappropriate for articles having closed handles such as luggage. In addition, the Yorty device is more complex than those presently disclosed herein in that a buckle arrangement is required for the strap.

U.S. Pat. No. 1,658,174 to Russell shows a pair of interfitting luggage handles on one piece of luggage or a briefcase. For carrying purposes, a convex surface of one of the handles interfits with a concave surface of the other handle. The Russell patent discloses the alternate possibility of the concave surface of the one being placed together with the convex surface of a handle of another bag or briefcase, but I believe that due to conventional positioning of handles, and differences of handle configurations in luggage and cases, that alternate possibility has extremely limited applicability. Besides, Russell does not disclose means for carrying more than two handles on different articles. My invention enables, with one hand, conveniently carrying two or more articles of luggage or cases having conventional, conventionally located handles.

SUMMARY OF THE INVENTION

One embodiment of the present invention comprises a first loop portion, a second loop portion having means therein for mating with the first loop portion, and an intermediate strap portion connecting the loop portions, whereby, when the handles of one or more of a plurality of articles having handles to be carried, are encircled by the strap portion, and the loop portions are mated, they serve as a handle which may be grasped together with the handle of another article for carrying the articles.

In another embodiment of this invention, the unit has a first loop which serves as a handle. The strap portion extends from this loop and terminates with a latch. Upon folding the strap portion upon itself, the latch is engageable with the end portion of the strap at the loop for latching ends together.

It is an object of the present invention to provide a gripping apparatus to assist in the simultaneous carrying of a plurality of articles which have handles, such as luggage.

Further objects and advantages of the present invention shall be apparent from the accompanying figures and detailed description.

DESCRIPTION OF THE PREFERRED EMBODIMENT

Figure 1:
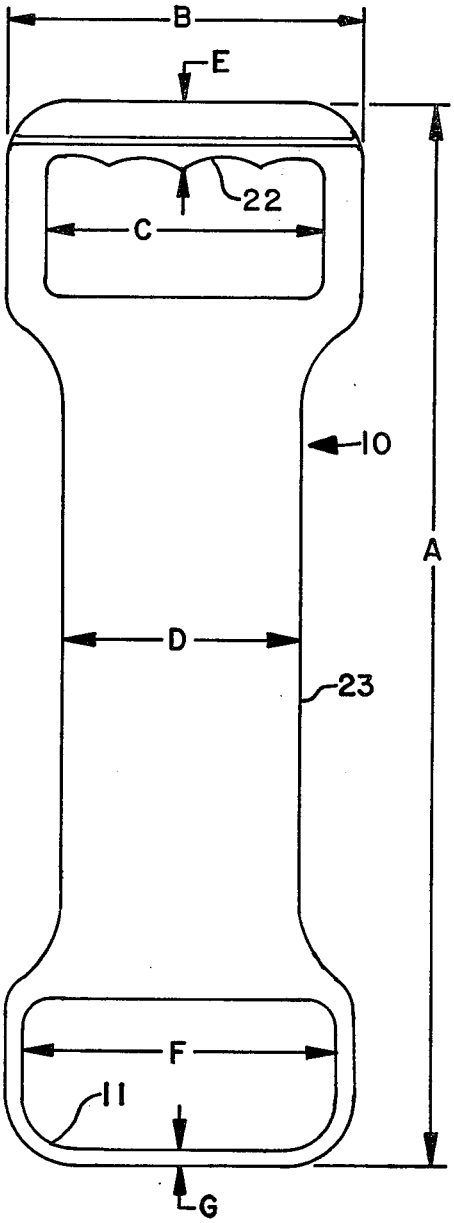
FIG. 1 is a front view of an embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
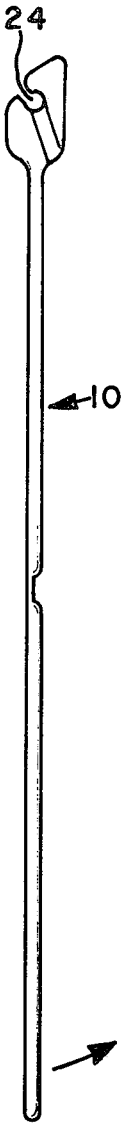
FIG. 2 is a side view of the embodiment of FIG. 1.
Figure 3:
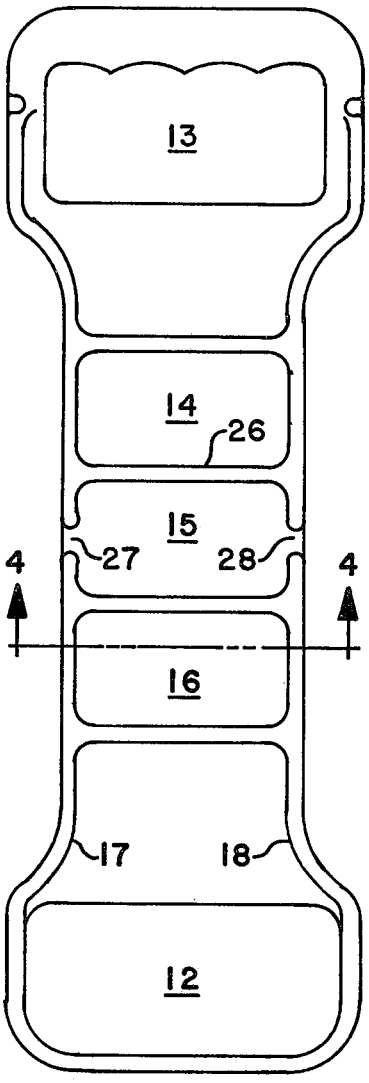
FIG. 3 is a rear view of the embodiment of FIG. 1.

Referring in particular to FIGS. 1 through 3, there is shown one embodiment of a gripping apparatus for carrying a plurality of articles according to the present invention. Gripping apparatus 10 includes loop portions 11 and 22 and intermediate portion 23. Part of loop portion 22 is thicker than the other portions of gripping apparatus 10, as best shown in FIG. 2, the loop portion 22 includes slot 24 within this thicker portion (FIG. 2).

Figure 4:
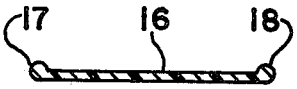
FIG. 4 is a cross-sectional view of the embodiment of FIG. 3 taken along the line 4—4 and in the direction of the arrows.

As best shown in FIG. 3, intermediate portion 23 comprises thin-walled areas 14, 15 and 16, which are separated by transvere ribs such as 26. Extending along the edges of intermediate portion 23, from the attachment points of loop portions 11 and 22 and intermediate portion 23, are thick side boundaries such as 17 and 18. Gaps 27 and 28 are left between the boundaries extending from the opposite loop portions. Gripping apparatus 10 is an integral unit of flexible plastic material, and gaps 27 and 28 facilitate the bending of gripping apparatus 10 into the carrying position described hereinafter. Thin walled area 16 and thick plastic boundaries 17 and 18 are shown in cross section in FIG. 4.

Figure 5:
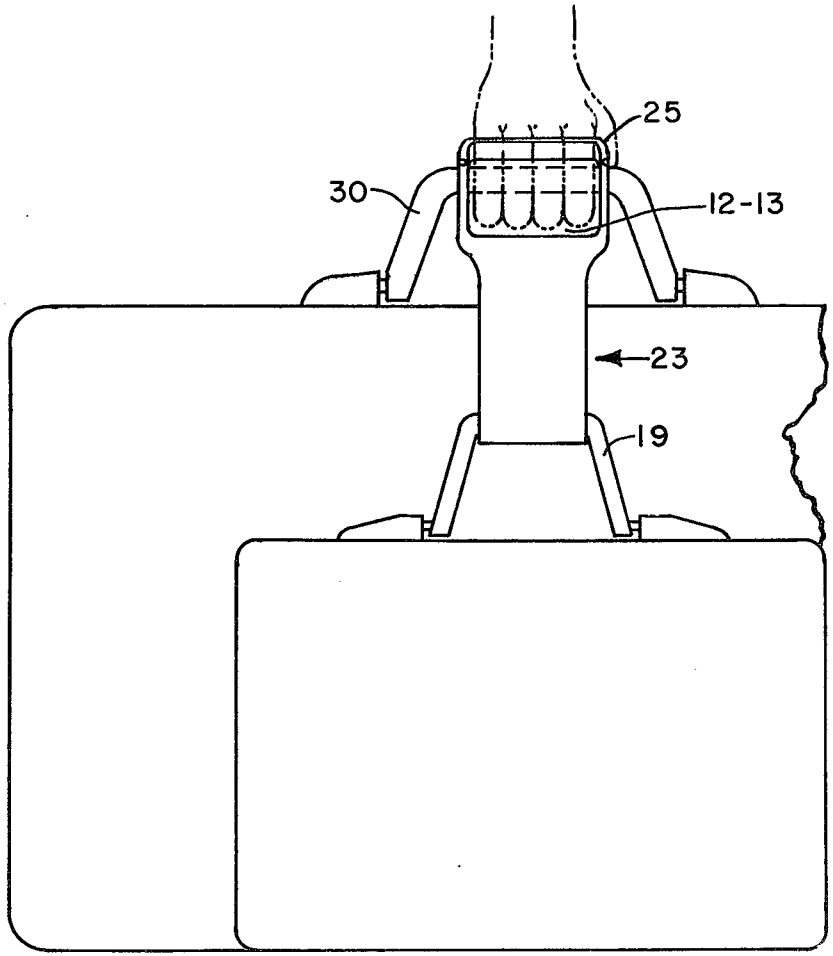
FIG. 5 shows the embodiment of FIGS. 1 through 4 in a carrying position encircling the handle of an attache case.
Figure 6:
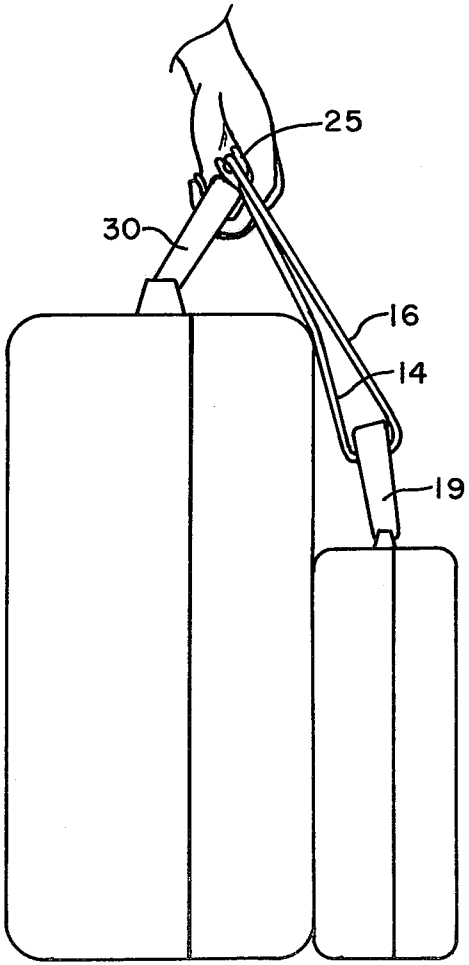
FIG. 6 is an end view of the combination shown in FIG. 5.

As shown in FIGS. 5 and 6, gripping apparatus 10 is in its carrying position. The areas 12 and 13, defined by loop portions 11 and 22 respectively, are adjacent in this position, and the intermediate portion 22 encircles attache case handle 19. Loop portion 11 is received within slot 24 of loop portion 22 and the two portions are thus mated, becoming handle portions and serving as a handle 25. In order to carry the cases as shown in FIG. 6, loop portions 11 and 22 are grasped simultaneously by extending the fingers through areas 12 and 13, and the handle 30 of the large suitcase is placed immediately thereunder and likewise grasped in the hand, and the combination is lifted and carried.

Upon arrival at a destination, the cases are set down and the handles 25 and 30 are released. However, due to the length of the unit from handle 19 to handle 25 (approximately 7 inches), handle 25 will rest conveniently on top of the large case, while both rest on the floor, ready to again be picked up and carried. Upon arrival at the final destination, loop portion 11 may be easily removed from slot 24 in loop portion 22, and gripping apparatus 10 removed from its position encircling handle 19.

Preferred dimensions of the embodiment of FIG. 1–3 are:

| | | | |
|---|---|---|---|
| A. | 14 inches | E. | 3/4 inches |
| B. | 4-3/4 inches | F. | 4-3/8 inches |
| C. | 3-3/4 inches | G. | 3/16 inches |
| D. | 3-1/4 inches | | |

Figure 7:
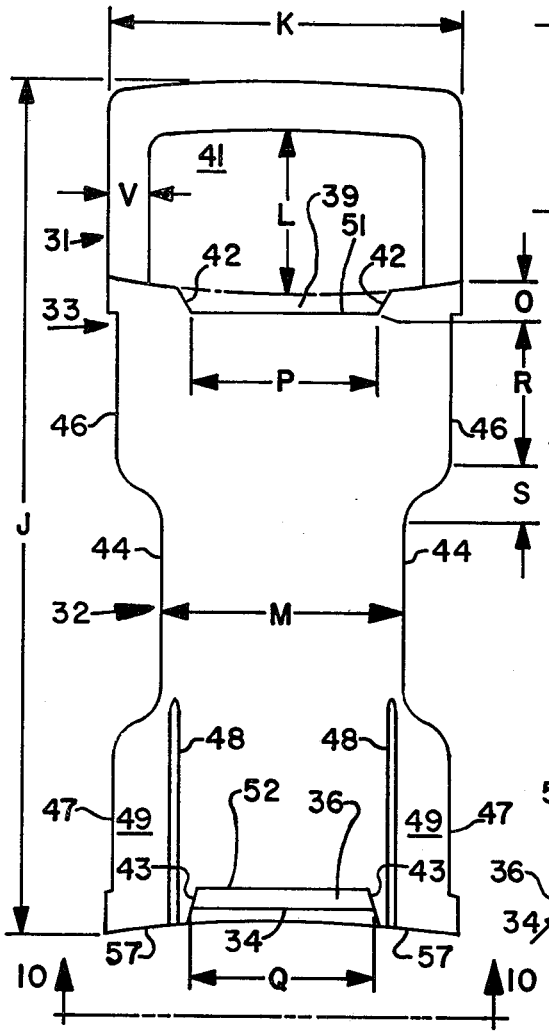
FIG. 7 is a front or outside view of the second and preferred embodiment of the invention in an open condition.
Figure 8:
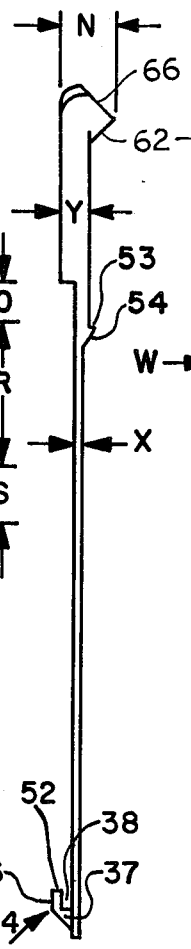
FIG. 8 is a side view of the embodiment of FIG. 7.
Figure 9:
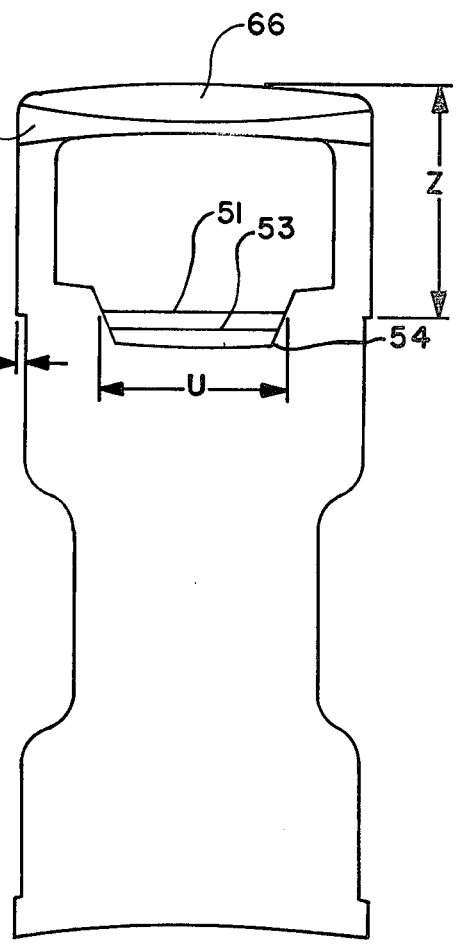
FIG. 9 is a rear or inside view of the open unit.
Figure 10:
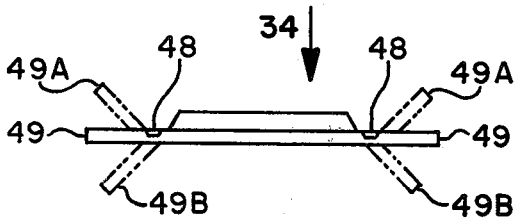
FIG. 10 is an end view of the open unit taken at line 10—10 in FIG. 7 and viewed in the direction of the arrows.

Referring now to the embodiment of FIGS. 7–10, there is a loop portion 31 which serves as a handle, and a strap portion 32 which adjoins the loop portion at 33. A lug 34 is provided near the end of the strap opposite the handle. As shown in FIG. 8, the lug includes a tongue 36 and the tongue spacer and mount 37, these cooperating with the strap to form a slot 38. A notch 39 is provided in the strap at the handle opening 41 and has sloped edges 42 which cooperate with the sloped edges 43 of the lug when the unit is folded to the condition shown in FIGS. 11–14 to align the two ends and edges of the strap portion. There are two edges 44 indented with respect to edges 46–47 of the unit to fit within the handle of the luggage to be carried by the unit. In order to facilitate inserting the lugged, handleless end of the unit through a luggage handle, a pair of grooves 48 is provided as shown in FIGS. 7 and 10. These are slightly inboard of the indented edges 44 and extend to the lugged end of the strap portion. They facilitate folding of wing portions 49 of the strap in the direction of the projection of the lug as shown by the dotted lines 49A in FIG. 10 to facilitate passing this end of the strap through a luggage handle, such as handle 51 of the case 50 in FIG. 14. The resilience of the plastic material of the strap will cause it to return to the solid line position of FIG. 10 when the manual force is removed.

In the use of the unit of FIGS. 7–10, after passing the lugged end through the handle of the case as just described, the lugged end is pulled up to the position shown in FIG. 11–14 and the lug is hooked over the top edge 51 of the notch 39. When the lug 34 has been hooked over the edge 51, the end 52 of the lug becomes disposed in face-to-face relation with the end 53 of a shield cam 54. At this time, the upper edge portion 51 of the strap is in the slot 38 to securely prevent separation of the lugged end of the strap from the handle and in the direction of the arrow 56 in FIG. 12. At the same time, the wing portions 49 have their upper edges 57 in abutting relationship with the shoulders 58 under the handle portion to prevent separation of the lugged portion in the direction of the arrow 59 in FIG. 12. The shield cam 54 shields the end 52 of the lug 34 from grazing blows so that they cannot strike the end of the lug and dislodge it in the direction of the arrow 59.

Figure 12:
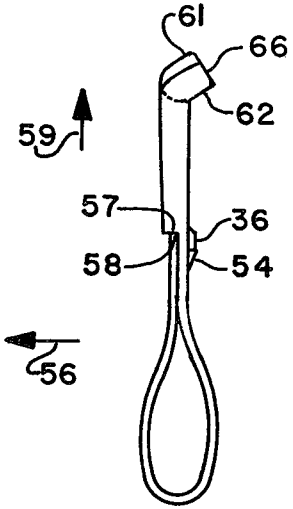
FIG. 12 is an end view thereof.
Figure 11:
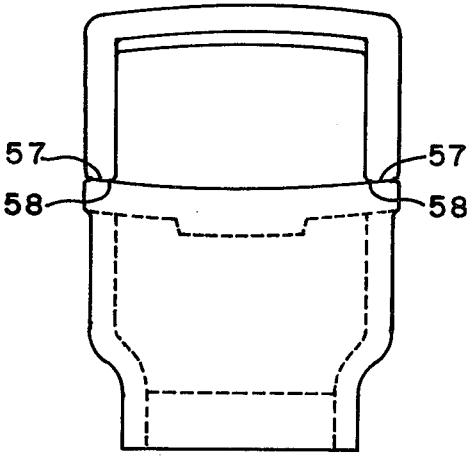
FIG. 11 is a front or outside view of the unit in the folded condition for carrying.

Further consideration of this matter will reveal that during closure of the unit, as the lug is pushed down over the edge 51, the wing portions deflect to the position shown by the dotted lines 49B in FIG. 10, in order to clear the shoulders 58 and then snap into a position under the shoulders 58 as shown in FIGS. 11 and 12.

Figure 13:
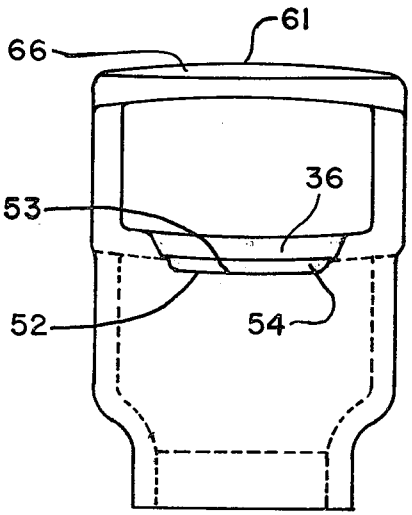
FIG. 13 is a rear view thereof.
Figure 15:
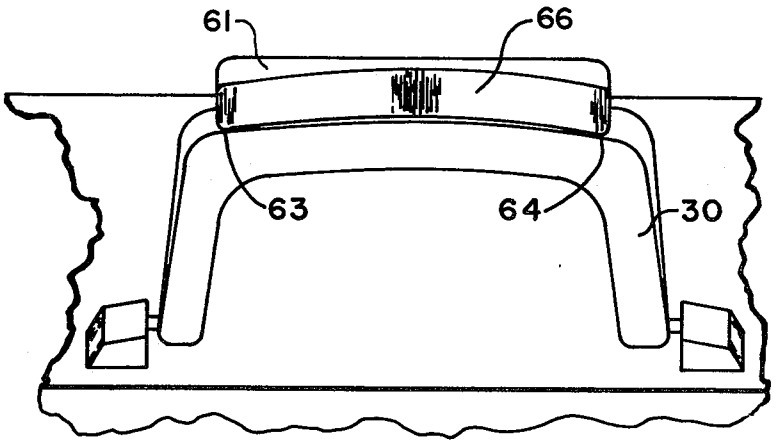
FIG. 15 is a view taken at line 15—15 in FIG. 14 and viewed in the direction of the arrows.
Figure 14:
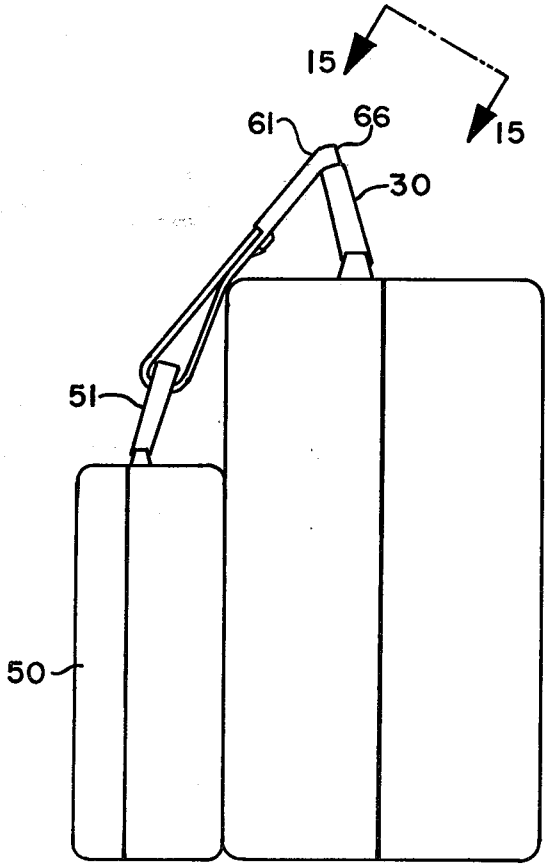
FIG. 14 is a view similar to FIG. 6 but showing the embodiment of FIG. 7.

Referring further to FIGS. 8, 9, and 12 through 14, it can be seen that point-to-point bight portion 61 of the handle has an inclined lower rear face 62 which is curved from end to end as is the top of the bight portion. The upward slant of the face 62 aids in fitting together this handle and the luggage handle to be carried in the same hand with it as shown in FIG. 14, where luggage handle 30 is carried conveniently with its bight portion immediately under the bight portion of the handle of this invention. Also, the curvature of the bight portion 61 as shown in FIGS. 9, 13, and 15 enables a pointto-point type of contact with the bight portion of the luggage handle 26 as shown at 63–64 in FIG. 15. Therefore, even if the bight portion of the luggage handle is somewhat curved as shown, there is a stable mating of the two handles in the hand of the person carrying them.

By way of example, preferred dimensions for the embodiment of FIGS. 7–15 are as follows:

| | | | |
|---|---|---|---|
| J. | 11-1/4 inches | R. | 2 inches |
| K. | 4-3/4 inches | S. | 3/4 inches |
| L. | 2-1/8 inches | U. | 2-1/2 inches |
| M. | 3-1/4 inches | V. | 1/2 inch |
| N. | 3/4 inches | W. | 1/8 inch |
| O. | 1/2 inches | X. | 1/8 inch (or less) |
| P. | 2-1/2 inches | Y. | 3/8 inch |
| Q. | 2-1/2 inches | Z. | 3-1/8 inches |

In FIGS. 9 and 12 through 15, a surface 66 generated by revolution of a line about an axis about 18 inches away, for example, is provided on the rear of the handle, adjacent and above surface 62 which is generated in the same way. This surface 66 facilitates gripping handles together side by side instead of the illustrated one above the other relationship shown in FIGS. 14 and 15. It serves to both reduce the overall horizontal thickness of the two handles squeezed together, and enhances the stability by providing the arcuate shape and two point contact much as shown at 63–64 in FIG. 15.

What is claimed is:

1. Handle extension to facilitate carrying a plurality of articles having handles, and comprising:

a first hand-receiver loop portion;

a strap portion having one end permanently connected to said loop portion and having its other end insertable through handles of articles to be carried and then closable for temporary attachment to said loop portion for carriage of one or more articles whereby, when the handles of one or more articles having handles to be carried are encircled by the strap portion, the first loop portion may be grasped together with the handle of another article to provide a single grip for carrying a plurality of articles, said loop portion including a pair of generally parallel horizontally spaced arms, each arm having one end joined to said one end of said strap portion and each arm having another end joined to a bight portion extending between said arms;

said strap portion having opposite edges at its one end spaced from each other for adjacency with the outer edges of said arms, and said strap portion having its outer edges converge toward each other to a reduced spacing at a portion of said strap portion equidistant between the ends of said strap portion, said reduced spacing being slightly less than the spacing between the inner edges of said arms, said reduced spacing thereby adapted to fit within the handle of the luggage to be carried but preclude shifting along the bail of the handle of the luggage to be carried.

2. The apparatus of claim 1 in which said other end includes a second hand-receiver loop portion, and said first loop portion and most of the strap portion are an integral unit of a flexible plastic material.

3. The apparatus of claim 1 in which said other end includes a second loop portion having a bight and adjoining parallel arms, said first loop portion having a slot therein sized to receive the second loop portion, the slot being along the edge of the bight of said first loop portion which is most distant from the second loop portion when the apparatus is opened flat, and the slot having ends extending, when the apparatus is opened flat, toward the second loop portion to receive the bight and parts of the arms of said second loop portion in said slot.

4. The apparatus of claim 3 in which the two loop portions and the strap portion are an integral unit of a flexible plastic material.

5. The apparatus of claim 4 in which the strap portion comprises a flexible plastic webbing having interspersed ribs thicker than the webbing.

6. The apparatus of claim 5 on which the majority of the strap portion is essentially a rectangular plastic sheet of webbing having first ribs which extend along the edges of the webbing as continuations of the loop portions and a plurality of second ribs transverse to the first ribs.

7. The appearance of claim 6 in which there is an unribbed portion of webbing located between the first ribs which extend from the different loop portions.

8. Handle extension to facilitate carrying a plurality of articles having handles, and comprising:

a hand-receiver loop portion;

a strap portion having one end permanently connected to said loop portion and having its other end insertable through handles of articles to be carried and then closable for temporary attachment to said loop portion for carriage of one or more articles whereby, when the handles of one or more articles having handles to be carried are encircled by the strap portion, the loop portion may be grasped together with the handle of another article to provide a single grip for carrying a plurality of articles, the other end of said strap portion being without a permanent hand-receiver loop portion, and latch means on said strap portion adjacent said other end thereof and engageable with the one end of said strap portion to retain said strap portion in article handle encircling condition, said strap portion extending between said loop portion and said latch means and having a reduced width slightly less than the width of said loop portion to preclude shifting of the handle of the article carried by said reduced width.

9. The apparatus of claim 8 in which:

said latch means include a hook;

a strap portion edge receiving said hook thereover whereby said one end and said other end are held together in face-to-face relationship.

10. The apparatus of claim 9 wherein:

said strap portion has interlocking hook retainer means including shoulder means adjacent said loop portion, and shoulder abutment means adjacent said hook, said shoulder means facing in the same direction as said hook and said abutment means facing in the opposite direction from said hook when said hook is hooked over the edge of said one end of said strap portion and said ends are in face-to-face relationship, said abutment means and said shoulder means abutting to prevent said hook from separating from said one edge.

11. Handle extension to facilitate carrying a plurality of articles having handles, and comprising:

a first hand-receiver loop portion;

a strap portion having one end permanently connected to said loop portion and having its other end insertable through handles of articles to be carried and then closable for temporary attachment to said loop portion for carriage of one or more articles whereby, when the handles of one or more articles having handles to be carried are encircled by the strap portion, the first loop portion may be grasped together with the handle of another article to provide a single grip for carrying a plurality of articles, latch means on said strap portion adjacent said other end thereof and engageable with the one end of said strap portion to retain said strap portion in article handle encircling condition, said latch means including a hook, said hook being received over an upper edge of said strap portion whereby said one end and said other end of said strap portion are held together in face-to-face relationship, said strap portion having interlocking hook retainer means including shoulder means adjacent said loop portion, and shoulder abutment means adjacent said hook, said shoulder means facing in the same direction as said hook and said abutment means facing in the opposite direction from said hook when said hook is hooked over the edge of said one end of said strap portion and said ends are in face-to-face relationship, said abutment means and said shoulder means abutting to prevent said hook from separating from said one edge, said loop portion including a pair of horizontally spaced arms, each having one end joined to said one end of said strap portion and each having another end joined to a bight portion extending between said arms;

said shoulder means including a pair of shoulders on one side of said apparatus, one of said shoulders being under each of said arms at the junction of said arms with said strap portion, said abutment portion being a pair of wings at the other end of said strap portion and at each side of said hook and facing said bight portion when said strap is in the closed article handle encircling condition, said shoulders facing away from said bight portion.

12. The apparatus of claim 11 and further comprising an anti-snag cam shield on the side of said apparatus opposite said shoulder means and immediately under the end of said hook where hooked over said edge of said one of said strap portion to prevent the end of said hook from being accidentally dislodged.

13. Handle extension to facilitate carrying a plurality of articles having handles, and comprising:

a first hand-receiver loop portion;

a strap portion having one end permanently connected to said loop portion and having its other end insertable through handles of articles to be carried and then closable for temporary attachment to said loop portion for carriage of one or more articles whereby, when the handles of one or more articles to be carried are encircled by the strap portion, the first loop portion may be grasped together with the handle of another article to provide a single grip for carrying a plurality of articles, the other end of said strap portion being without a permanent hand-receiver loop portion, and latch means on said strap portion adjacent said other end thereof and engageable with the one end of said strap portion to retain said strap portion in article handle encircling condition, said latch means including a hook, a strap portion edge receiving said hook thereover whereby said one end and said other end are held together in face-to-face relationship, said strap portion having interlocking hook retainer means including shoulder means adjacent said loop portion and shoulder abutment means adjacent said hook, said shoulder means facing in the same direction as said hook and said abutment means facing in the opposite direction from said hook when said hook is hooked over the edge of said one end of said strap portion and said ends are in face-to-face relationship, said abutment means and said shoulder means abutting to prevent said hook from separating from said one edge.

* * * * *